United States Patent [19]

Gedeit

[11] 4,120,161

[45] Oct. 17, 1978

[54] EXTERNAL HEAT ENGINE

[76] Inventor: Reinhold C. Gedeit, 613 Beloit Ave., Forest Park, Ill. 60130

[21] Appl. No.: 841,577

[22] Filed: Oct. 12, 1977

Related U.S. Application Data

[63] Continuation-in-part of Ser. No. 642,361, Dec. 19, 1975, abandoned, and Ser. No. 763,302, Jan. 28, 1977, abandoned.

[51] Int. Cl.[2] ..... F02G 1/02

[52] U.S. Cl. ..... 60/682

[58] Field of Search ..... 60/650, 682, 516, 517

[56] References Cited

U.S. PATENT DOCUMENTS

| | | | |
|---|---|---|---|
| 868,441 | 10/1907 | Jenkins | 60/682 |
| 3,256,691 | 6/1966 | Dobossy | 60/682 X |
| 3,708,979 | 1/1973 | Bush et al. | 60/682 X |
| 3,867,816 | 2/1975 | Barrett | 60/682 |

*Primary Examiner*—Allen M. Ostrager

*Attorney, Agent, or Firm*—Brezina & Lund

[57] ABSTRACT

An open cycle external heat engine is provided which is of the reciprocating piston type, having compression cylinders separated from larger power cylinders; the heating of the compressed air being accomplished in an air heater with the compressed air never mixing with the heating gases, a heat exchanger being provided for recovering and recirculating the heat of the combustion gases.

7 Claims, 6 Drawing Figures

EXTERNAL HEAT ENGINE

This application is a continuation-in-part of my copending applications Serial No. 642,361, filed Dec. 19, 1975 abandoned, and Serial No. 763,302, filed Jan. 28, 1977 also abandoned.

The invention relates to an open cycle external combustion engine of a reciprocating piston type, using heated compressed air as the prime mover and having compression cylinders separated from power cylinders which are generally larger in size or pass through them a larger volume of air in a given time interval than the compression cylinders. The compressed air is heated in an air heater, the heat being applied to it in such a way that the heating gases never mix with the compressed air within the heater. The combustion is continuous which results in complete combustion of the fuel and very low or no air pollution, depending on the type of combustible fluid used. Also, since combustion takes place at atmospheric pressure, the emission of nitrous oxides is quite negligible. Unlike internal combustion engines, there are no explosions taking place with the engine. Therefore, the engine runs almost noiselessly and helps to reduce the noise pollution now common in out cities.

BACKGROUND OF THE INVENTION

The basic idea of external heat engines of the reciprocating piston type using an air heater in which the compressed air is heated from the outside and in which the heating gases never mix with the compressed air within the heater has been known for quite a long time. The first known U.S. patent relating to this kind of engine is U.S. Pat. No. 1,038,805, granted to S. J. Webb in 1912. That engine lacked many important feature which would be needed to make it practical. Only two other U.S. patents are known to have been issued on this kind of engine, both of which are of the closed cycle type and therefore cumbersome, expensive to manufacture and not practical for general use. One basic feature which all three engines lack is a space for the heated air to expand under substantially constant pressure and to be accommodated before being admitted into the power cylinders. No engine of this kind will perform adequately, if it will run at all, without such expansion space, as hereinater explained.

The lack of the above mentioned feature and other shortcomings preventing this kind of engine from being successfully employed in the economy of this country and the world have been taken into consideration in this invention and shall be explained hereinafter.

OBJECTS OF THE INVENTION

The basic object of this invention is to provide an engine which will produce little or no air and noise pollution, at the same time being relatively easy to build and simple to operate, and having a life span several times that of a conventional internal combustion engine.

Another object of this invention is to provide an engine which is lightweight and will operate under moderate pressure and heat conditions, generally no more than 10 atmospheres pressure and 800° heat, while at the same time achieving a practical thermal efficiency which is several times higher than that of a conventional internal combustion engine.

A further object of this invention is to provide an engine in which the prime mover never mixes with the combustion gases to thus aid in keeping the engine cylinders, pistons and lubricating oil clean from carbon deposits, corroding chemical residue and abrasive grit which are the main causes of wear and tear in the present internal combustion engines.

GENERAL DESCRIPTION OF PREFERRED EMBODIMENTS AND THEIR FUNCTIONS

The basic construction of the engine of this invention is very similar to that of a conventional internal combustion engine in that it has cylinders, pistons, a crankshaft and connecting rods connecting the pistons with the crankshaft. The engine is different from the internal combustion engine in that compression takes place in compression cylinders which are separate from power cylinders in which power is produced and which generally have a larger volume than the compression cylinders.

Unike an internal combustion engine, combustion in the engine of this invention takes place within an air heater outside the engine block. Heat is generated by a burner unit which mixes combustion fluid with air at atmospheric pressure. The mixture is ignited by electric arc produced between two electrodes, after which electric current is shut off and the combustion continues spontaneously until the fuel supply is cut off.

To provide room for the compressed heated air to expand under constant pressure, a hot air reserve chamber is provided into which the compresed, heated and expanded air is passed before being admitted into the power cylinders. Without this air chamber the engine would hardly be able to run and would never be able to achieve a quick acceleration which is needed for automobiles and many other mobile and stationery objects.

Valves shown in the drawings accompanying this application are of the rotary type, as being best suited for this kind of engine, although valves of any other design and type could be used more or less successfully, if the necessary pressure seals are provided and lubrication problems of the valve stems of shafts are solved.

The volume of the power cylinders as against the compression cylinders is worked out by first determining the desired pressure and heat levels under which the engine will operate, and then calculating the final volume of the expanded air at atmospheric conditions, before it is expelled from the power cylinders.

If the heat level is reduced from the calculated value, this reduction will also reduce the final air volume at atmospheric conditions within the power cylinders, and since the size of the power cylinders will not change, the pistons will travel the final one tenth or more of their downward stroke under partial vacuum in the power cylinders, while the pressure under pistons will remain atmospheric. This back pressure will cause a certain power loss of the engine. This power loss can best be recovered by leaving the exhaust valve closed until the pistons rise again to a level where atmospheric pressure within the cylinders becomes equal to the atmospheric pressure under the pistons. To make this practical, a control device in the form of a curved slide has been installed on one lower side of the rotary exhaust valve. This slide delays the opening of the exhaust valve until equilibrium of atmospheric pressure is reached above and below the power pistons on their upward stroke.

A similar device has been installed on one lower left side of the inlet valve of the power cylinders. Its purpose is to keep the pressure level within the air heater and the hot air reserve chamber constant while permitting the heat level to be varied, i.e. reduced or increased. This is especially important in automobile engines when sudden power increase for a fast overtaking maneuver is needed. It is a well-known fact that it takes a longer time to transfer heat through the walls of a heater than when combustion takes place within the compressed air itself. Without this control device power pickup would be somewhat sluggish and there also would be loss of thermal efficiency due to drop of pressure within the air heater and hot air reserve chamber whenever the heat level is reduced.

A heat exchanger is mounted on the combustion gas exhaust duct for the purpose of recovering heat which is leaving the air heater with the combustion gases. Without the heat exchanger, large amounts of heat would be lost and the engine would have a poor total thermal efficiency. This is due to the fact that the compression of the air to be heated is largely adiabatic, and the compressed air reaches the heater at a high temperature, around 570° A at a pressure of 10 atmospheres, for example. Therefore, the combustion gases coming out of the air heater are at least as hot, and without a heat exchanger such heat would be lost. In the heat exchanger such heat is given off by the exhaust gases to atmospheric air passing through the heat exchanger. When the heated up atmospheric air leaves the heat exchanger, it is drawn by the burner fan or blower into the burner where it is mixed with fuel and burned, and the resulting hot gases are passed through the air heater to heat the compressed air within the heater.

A fuel pump in combination with a fuel volume control device regulates the fuel flow to the burner assembly of the engine. The fuel flow is generally controlled manually, and such a manual control is shown in the drawings, although automatic controls can be installed in stationary engines, if desired. The manual control is overridden by a combination of pneumatic-thermostatic pressure and heat sensing devices as soon as the permissible maximum pressure and heat levels are exceeded. This device can be mounted anywhere on the hot air reserve chamber or inlet valve housing of the power cylinders.

Insulation material is provided around all ducts, air heater, hot air reserve chamber, heat exchanger and around the valve housings to prevent heat loss and also to protect the surroundings from fire hazard.

Cooling of the engine cylinders is effected by air drawn in by a blower at one end of the engine. The air is passed around the cylinders cooling them and is then expelled at the other end of the engine. Since the average operational temperatures of this engine are relatively low, the expanded air within the power cylinder often being well below the boiling point of water at atmospheric conditions, little cooling is needed and therefore the heat loss through the cylinder walls is relatively low.

The engine can be started manually, since there is no elevated pressure within the air delivery system as long as the burner is not working. Pressure builds up gradually after heat is supplied to the heater. If desired, an electric or pneumatic starter can be added to the engine.

IN THE DRAWINGS

DETAILED DESCRIPTION OF THE DRAWINGS

Figure 1:
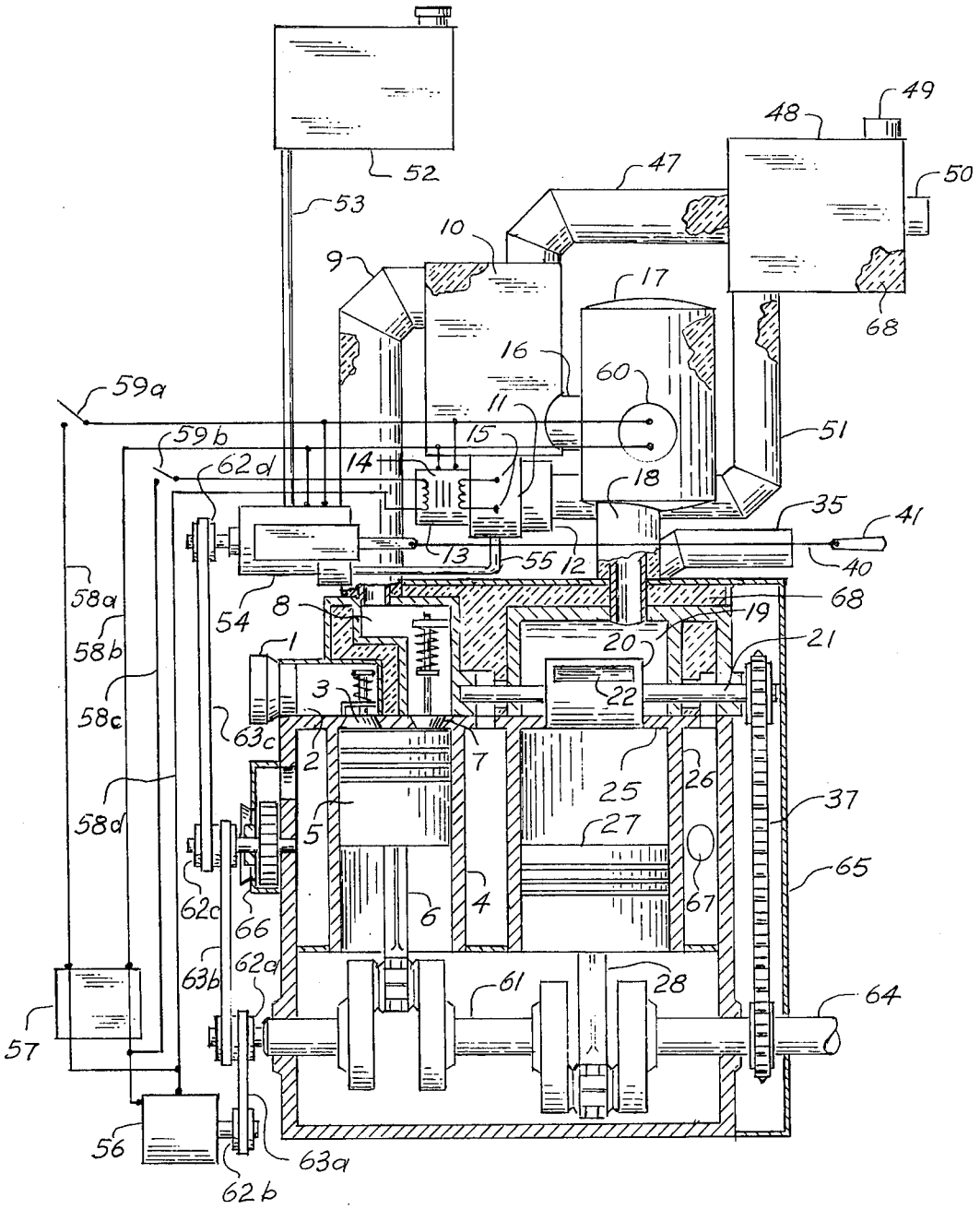
FIG. 1 is a side elevational view of an engine according to this invention, partly in section to show compression cylinder valves, power cylinder inlet valve and their housings, cylinders and pistons and crankshaft.
Figure 2:
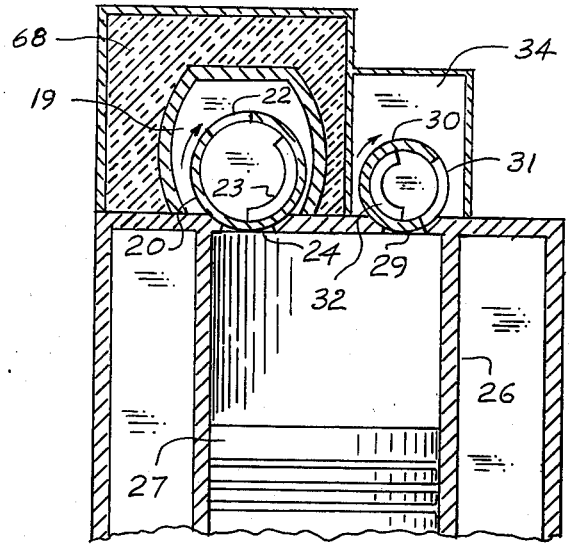
FIG. 2 is a sectional view through power cylinder inlet and outlet valves and their housings, showing insulating around an inlet valve housing.

Atmospheric air is drawn into the engine through an air filter assembly 1 into a compression cylinder inlet valve housing 2. When a piston 5 descends in a cylinder 4, a valve 3 opens allowing atmospheric air to enter the compression cylinder 4. As soon as the piston 5 reaches the bottom of its stroke, the valve 3 closes and as piston 5 begins to travel upwards, as valve 7 opens allowing the air in cylinder 4 to pass into a valve housing 8, and from there through a duct 9 into an air heater 10. As the air passes through the heater 10, it picks up heat supplied to it by a burner unit 11 and leaves the heater through a duct 16, passing first into a hot air reserve chamber 17 and from there through a duct 18 into a power cylinder inlet valve housing 19.

When a power piston 27 has reached the top of its stroke, a slot 22 of a rotary valve 20 on a shaft 21 registers with an inlet port 24 located in a cylinder head 25, and as the power piston 27 begins to descend in a power cylinder 26, the hot compressed air enters the cylinder 26, exerting full pressure on power piston 27 until the slot 22 has turned away from the inlet port 24. To allow the hot compressed air unrestricted passage into the inside of rotary valve 20 when slot 22 is in register with inlet port 24, slots 23 (FIGS. 2–5) are provided on both ends of the rotary valve 20.

Aftere the inlet valve 20 closes and allows no more hot compressed air to enter power cylinder 26, the hot air expands until piston 27 reaches the bottom of the stroke. Now a slot 31 of a rotary exhaust valve 30 registers with an exhaust port 29 located in the cylinder head 25 (FIGS. 2–5), and as the piston 27 travels upwardly, the expanded and cooled down air is expelled from the cylinder 26 through the exhaust port 29, the slot 31 of exhaust valve 30 and valve end slots 32 (FIGS. 2–5), and thence through an exhaust pipe 35 into the outside.

Figure 4:
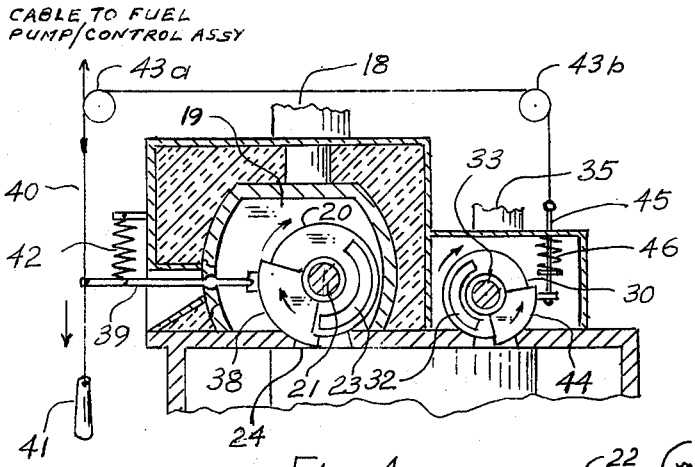
FIG. 4 is a view similar to FIG. 3, constituting an end view of power cylinder inlet and outlet valves and also showing slides and a mechanism by which the slides are manipulated.
Figure 5:
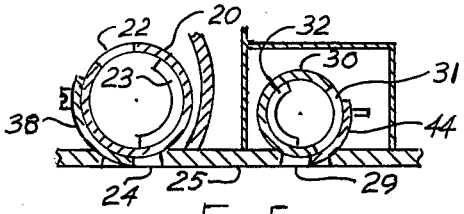
FIG. 5 is a cross sectional view of power cylinder inlet and outlet valves and slides.

Since reduction of the heat level of the compressed air might result in reduction of pressure and thus loss of thermal efficiency of the engine, a curved slide 38 of FIGS. 4 and 5 is mounted on the valve shaft 21. The slide 38 covers a part of the inlet port 24 when the engine is idling. Slide 38 is controlled by a lever 39. When lever 39 is depressed, the slide 38 moves in the direction indicated by an arrow in FIG. 4, providing a wider opening of inlet port 24 and thus permitting a larger volume of hot compressed air to enter the power cylinder 26, thereby increasing the power output of the engine. Lever 39 of FIG. 4 is connected by a cable 40 to a fuel pump and fuel flow control unit 54. Therefore, when lever 39 is depressed and moves slide 38 away from inlet port 24, it also increases the fuel flow from pump 54 into burner 11 which in turn increases the heat input of the engine and thus helps to maintain, by increasing the volume of the hot compressed air, the predetermined pressure level and with it the thermal efficiency of the engine.

Figure 3:
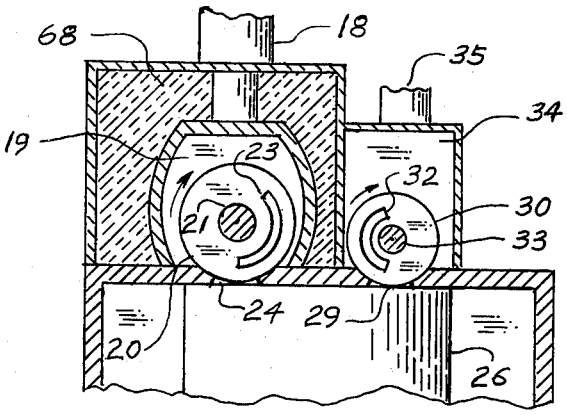
FIG. 3 is another sectional view which constitutes an end view of power cylinder inlet and outlet valves.

A curved slide 44 is also provided on the lower right side of rotary exhaust valve 30, mounted on shaft 33 of FIGS. 3 and 4. It covers a predetermined area of exhaust port 29 when the engine is idling or running at less than full speed. The slide 44 operates to prevent atmospheric air from entering power cylinder 26 when power piston 27 is in its final phase of the downward stroke and initial phase of its upward stroke, when power cylinder 26 is under partial vacuum. The slide 44 is connected with a rod 45 and cable 40 which extends around pulleys 43*a* and 43*b* to lever 39. When lever 39 is forced down by pulling the handle 41 of FIG. 4, it activates at the same time slide 38, the power pump 54 and slide 44. When slide 44 is moved away from exhaust port 29, the time interval during which port 29 is closed is shortened. A spring 42 keeps lever 39 up and thereby slide 39 down, and a spring 46 keeps slide 44 also down while the engine is idling (FIG. 4).

Figure 6:
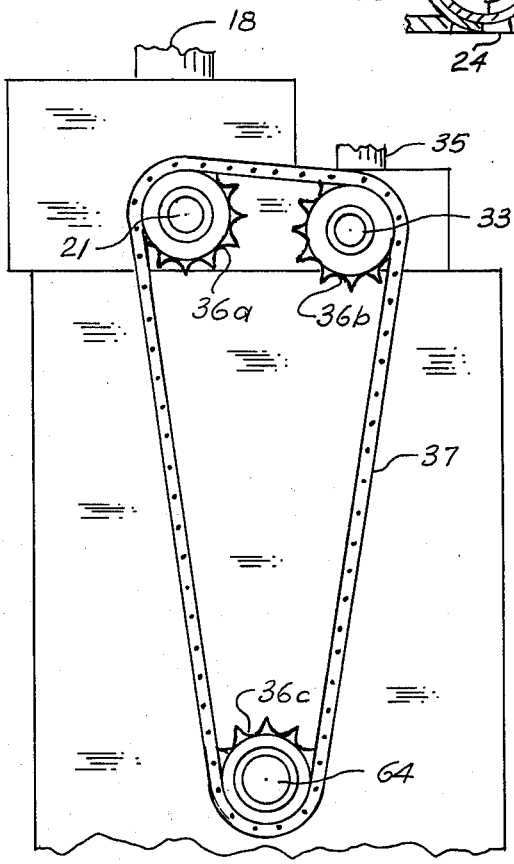
FIG. 6 is an end elevational view showing the chain drive of the power cylinder inlet and outlet valves.

Inlet valve 20, mounted on shaft 21, and exhaust valve 30, mounted on shaft 33, are driven by a chain drive from a power shaft 64. Sprocket 36*a* is mounted on inlet valve shaft 21, sprocket 36*b* on exhaust valve shaft 33, and a sprocket 36*c* is mounted on power shaft 64 (FIG. 6). A drive chain 37 is entrained around sprockets 36*a*, 36*b* and 36*c*, rotating the rotary valves 20 and 30 in synchronism with the strokes of power piston 27.

Electric current is supplied to the engine by an electric generator 56 and a battery 57. The generator 56 is driven by a V-belt 63*c*, entrained around pulleys 62*b* and 62*a*, the latter being mounted on an extension of crankshaft 61. Electric cables 58*a* and 58*b* connect battery 57 with generator 56, and also with the fuel volume control portion of fuel pump unit 54, with an electric motor 15 being mounted on burner unit 11 for driving a blower 12, and with a pneumatic-thermostatic heat and pressure control unit 60 being provided to operate to prevent the pressure and heat in heater 10 and hot air reserve chamber 17 from exceeding the predetermined limits by reducing fuel flow from fuel pump and fuel volume control unit 54 through fuel line 55 to burner unit 11.

Electric cables 58*c* and 58*d* connect battery 57 and generator 56 with transformer 14 mounted on electric motor 13. Transformer 14 is provided to boost the voltage of electrodes 15 so that an electric arc can be maintained for igniting the fuel-air mixture supplied to burner 11 by fuel pump 54 and air blower 12. Switch 59*b* on electric cable 58*c* is engaged to activate transformer 14 and electrodes 15. After combustion is initiated, switch 59*a* is disengaged and combustion continues spontaneously. Switch 59*a* on electric cable 58*a* is engaged to activate electric motor 13, the fuel volume control portion of fuel pump 54, and pneumatic-thermostatic pressure and heat control device 60 on hot air reserve chamber 17. The engine is stopped by disengaging switch 59*a*.

Fuel is supplied to fuel pump and fuel volume control unit 54 from fuel tank 52 via the fuel line 53.

Fuel pump 54, less the fuel volume control unit, is driven by a V-belt 63*c* running around fuel pump pulley 62*d* and blower pulley 62*c*. Pulley 62*c* is also connected by V-belt 63*b* to crankshaft extension pulley 62*a*, V-belt 63*b* driving the blower unit 66 which supplies cooling air to compression cylinder 4 and power cylinder 26. The cooling air is exhausted through port 67.

The combustion gases leaving heater 10 are conducted via duct 47 into heat exchanger 48 and leave the system through exhaust pipe 50 into the outside.

Air needed for combustion enters the heating system through air intake 49. It then passes through the heat exchanger 48 absorbing most of the heat of the combustion gases, and then enters duct 51 and is drawn by blower 12 into burner unit 11 where it mixes with fuel and the mixture is burned, the hot gases heating the compressed air passing through the heater 10.

Insulation 68 covers valve housings 2, 8, 19 and 34, ducts 9, 16, 18, 47 and 51, heater 10, hot air reserve chamber 17 and heat exchanger 48. This is desirable so that as little heat as possible could escape the air handling system. Without insulation the engine would not only very inefficient, with most of the heat being radiated away or absorbed by outside air, but would also be a major fire hazard, since most gases and many solid combustible materials would ignite at temperatures of around 800° A.

Compression piston 5 and power piston 27 are connected by connecting rods 6 and 28 with crankshaft 61. Power shaft 64 which is a portion of crankshaft 61, extends through rotary valve chain drive cover 65.

No detailed description or drawings have been made of fuel pump and fuel volume control unit 54, burner unit 11, blower unit 12, air heater 10, heat exchanger 48 and pneumatic-thermostatic pressure and heat control unit 60, since all these parts can be obtained commercially and be easily fitted into the engine described above.

I claim as my Invention:

1. In an open cycle air engine of the reciprocating piston type having at least one compression cylinder and one power cylinder, the power cylinder being of larger volume than the compression cylinder, said engine having heater means for heating the compressed air, valve means for admitting atmospheric air into said compression cylinder, valve means for allowing said air after compression to leave said compression cylinder, means defining a passageway allowing said compressed air to enter said air heater, valve means for admitting said compressed and heated air into said power cylinder, valve means for allowing the expanded and cooled down air to leave said power cylinder after the power stroke is completed, a housing for said valve means, a cylinder cooling system, and insulating means around all hot parts of the engine facing the outside, the improvements comprising in combination, means defining a hot air reserve chamber for allowing the heated and compressed air to expand under constant pressure, means defining a passageway between said air heater means and said hot air reserve chamber, means defining a passage from said hot air reserve chamber to said valve housing for admitting said hot compressed air into said power cylinder, said air heater including a fuel feed control means, burner means for continuous combustion of combustible fliud, blower means for supplying atmospheric air to said burner means, and means to ignite the combustible fluid and air mixture; and means to control the maximum pressure and temperature within said hot air reserve chamber.

2. In an engine as defined in claim 1, a combustion gas exhaust duct, a heat exchanger mounted on said combustion gas exhaust duct, and arranged to receive cool outside air to absorb the heat from said combustion gas, and means defining a passageway leading from said heat exchanger to said blower means for conveying said warmed-up air to said burner means.

3. In an engine as defined in claim 2, said power cylinder inlet valve means comprising a rotary valve means, said rotary valve means including a valve member having slots on both ends thereof for allowing said hot compressed air to enter the interior of said valve member at all times, a slot on the side of said rotary valve member for allowing said hot compressed air to enter said power cylinder when said slot registers with the air inlet port of said power cylinder, and the exhaust valve means of said power cylinder comprising a rotary valve means including a valve member having a slot on its side for allowing the expended air to leave said power cylinder when said slot registers with the air outlet port when the power piston is on its upward stroke, slots being provided on both ends of said rotary exhaust valve member for allowing said expended air to leave the inside of said rotary exhaust valve member when said slot on the side of said rotary exhaust valve means is in register with said air outlet port, and means to rotate said rotary inlet and exhaust valves in synchronism with the power and exhaust strokes of power piston.

4. In an engine as defined in claim 3, a device for controlling the volume of said hot compressed air to be admitted into said power cylinder during each power cycle of the engine, and means to manipulate said device.

5. In an engine as defined in claim 3, a control device for delaying the opening of said rotary exhaust valve means as long as said power cylinder is under partial vacuum, and means to manipulate said device.

6. In an engine as defined in claim 4, said control device comprising a curved slide on one lower side of said rotary inlet valve means.

7. In an engine as defined in claim 5, said control device comprising a curved slide on one lower side of said rotary exhaust valve means.

* * * * *